US010011114B2

(12) United States Patent
Muto

(10) Patent No.: US 10,011,114 B2
(45) Date of Patent: Jul. 3, 2018

(54) LIQUID EJECTING APPARATUS AND WIPING METHOD

(71) Applicant: Seiko Epson Corporation, Tokyo (JP)

(72) Inventor: Atsushi Muto, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/283,627

(22) Filed: Oct. 3, 2016

(65) Prior Publication Data

US 2017/0100938 A1 Apr. 13, 2017

(30) Foreign Application Priority Data

Oct. 9, 2015 (JP) ..... 2015-201446

(51) Int. Cl.
*B41J 2/165* (2006.01)

(52) U.S. Cl.
CPC ..... *B41J 2/16544* (2013.01); *B41J 2/16535* (2013.01); *B41J 2/16538* (2013.01); *B41J 2/16508* (2013.01); *B41J 2/16523* (2013.01); *B41J 2/16585* (2013.01)

(58) Field of Classification Search
CPC ..... B41J 2/16544; B41J 2/16535
See application file for complete search history.

(56) References Cited

U.S. PATENT DOCUMENTS 9,457,578 B2 * 10/2016 Furukawa ..... B41J 2/16535
2005/0035991 A1 * 2/2005 Fredrickson ..... B41J 2/16535 347/33
2013/0222474 A1 * 8/2013 Williamson ..... B41J 2/16538 347/33

FOREIGN PATENT DOCUMENTS

JP 2010-052381 A 3/2010
JP 2012-171294 A 9/2012

* cited by examiner

*Primary Examiner* — Julian Huffman
(74) *Attorney, Agent, or Firm* — Harness, Dickey & Pierce, P.L.C.

(57) ABSTRACT

A liquid ejecting apparatus includes a liquid ejecting head that has a nozzle surface that is provided with nozzles for ejecting a liquid, a wiper for wiping the nozzle surface, a scanning mechanism configured to cause the nozzle surface and the wiper to perform a plurality of relative movements between the nozzle surface and the wiper, and a controller configured to control the scanning mechanism. The plurality of relative movements includes a first relative movement and a second relative movement that is different in the wiping from the first relative movement.

17 Claims, 13 Drawing Sheets

LIQUID EJECTING APPARATUS AND WIPING METHOD

CROSS-REFERENCE TO RELATED APPLICATIONS

This application claims priority to Japanese Patent Application No. 2015-201446 filed on Oct. 9, 2015. The entire disclosure of Japanese Patent Application No. 2015-201446 is hereby incorporated herein by reference.

BACKGROUND ART

1. Technical Field

The present invention relates to a liquid ejecting apparatus that includes a liquid ejecting head that ejects a liquid and to a wiping method. Particularly, the invention relates to an ink jet type recording apparatus that ejects ink as a liquid and to a wiping method for an ink ejecting head of the ink jet type recording apparatus.

2. Related Art

A known liquid ejecting apparatus that ejects a liquid to an ejection target medium is an ink jet type recording apparatus that performs printing on an ejection target medium (recording target medium), such as paper or a recording sheet, by discharging ink as a liquid.

An ink jet type recording head mounted in an ink jet type recording apparatus as mentioned above discharges ink as ink droplets from nozzles; therefore, ink adheres to the vicinity of a nozzle or adhered ink increases in viscosity, leading to a problem of unstable directions of discharge of ink droplets or a problem of occurrence of incomplete discharge of ink, such as an ink droplet failing to be discharged.

Therefore, a technology of cleaning a nozzle surface of an ink jet type recording head which is provided with nozzles by wiping the nozzle surface with a wiper (see, e.g., JP-A-2012-171294) has been proposed.

However, if the wiping of the nozzle surface leaves unwiped spots, there arises a problem that an ejection target medium comes into contact with the unwiped ink and becomes stained or a problem that unwiped spots accumulate fuzz and then ink retained by fuzz drops onto an ejection target medium at an unpredicted time and stains the ejection target medium.

Still another problem is that if the wiper is formed to have such a size as to entirely cover the nozzle surface, the apparatus increases in size. Incidentally, even in the case where a wiper having such a size as to cover the entire nozzle surface is provided, if one movement of the wiper relative to the nozzle surface does not wipe the entire nozzle surface, unwiped spots accumulate fuzz or ink, leading to the staining of the ejection target medium, similarly to the foregoing problems.

Note that such problems occur with not only ink jet type recording apparatuses but also liquid ejecting apparatuses that eject a liquid other than ink.

SUMMARY

An advantage of some aspects of the invention is that a liquid ejecting apparatus that restrains an ejection target medium from being stained because of an unwiped spot on the nozzle surface.

A liquid ejecting apparatus according to one aspect of the invention includes a liquid ejecting head that has a nozzle surface that is provided with at least one nozzle that ejects a liquid, a wiper that wipes the nozzle surface, a scanning mechanism that causes the nozzle surface and the wiper to perform a plurality of relative movements between the nozzle surface and the wiper, and a controller that controls the scanning mechanism. The plurality of relative movements includes a first relative movement that is a wiping of the at least one nozzle of the nozzle surface and a second relative movement that is a wiping of a portion of the nozzle surface that is other than the at least one nozzle.

In this aspect of the invention, performing the wiping by the first relative movement restores the at least one nozzle. Furthermore, performing the wiping of a portion of the nozzle surface which is other than the at least one nozzle by the second relative movement restrains an unwiped spot from being left on the portion other than the at least one nozzle and therefore restrains an ejection target medium from being stained by the liquid having adhered to the unwiped spot.

A liquid ejecting apparatus according to a second aspect of the invention includes a liquid ejecting head that has a nozzle surface that is provided with at least one nozzle that ejects a liquid, a wiper that wipes the nozzle surface, a scanning mechanism that causes the nozzle surface and the wiper to perform a plurality of relative movements between the nozzle surface and the wiper, and a controller that controls the scanning mechanism. The plurality of relative movements includes a first relative movement and a second relative movement that are different from each other in a moving speed and the moving speed of the second relative movement is lower than the moving speed of the first relative movement.

In this aspect, the second relative movement whose speed is relatively slow can certainly wipes off a liquid with an increased viscosity. Furthermore, performing the wiping by the first relative movement whose speed is relatively fast can reduce the amount of time in which printing is interrupted.

A liquid ejecting apparatus according to a third aspect of the invention includes a liquid ejecting head that has a nozzle surface that is provided with at least one nozzle that ejects a liquid, a wiper that wipes the nozzle surface, a scanning mechanism that causes the nozzle surface and the wiper to perform a plurality of relative movements between the nozzle surface and the wiper, and a controller that controls the scanning mechanism. The plurality of relative movements includes a first relative movement and a second relative movement that are different from each other in a contact pressure of the wiper on the nozzle surface and the second relative movement is higher in the contact pressure of the wiper on the nozzle surface than the first relative movement.

In this aspect, by the second relative movement with a relatively high contact pressure of the wiper on the nozzle surface, a liquid with an increased viscosity can be certainly wiped off. Furthermore, wiping the nozzle surface by the first relative movement with a relatively low contact pressure reduces or substantially prevents wear of the wiper and/or a liquid-repellent film formed on the nozzle surface.

A liquid ejecting apparatus according to a fourth aspect of the invention includes a liquid ejecting head that has a nozzle surface that is provided with at least one nozzle that ejects a liquid, a wiper that wipes the nozzle surface, a scanning mechanism that causes the nozzle surface and the wiper to perform a plurality of relative movements between the nozzle surface and the wiper, and a controller that controls the scanning mechanism. The plurality of relative movements includes a first relative movement and a second relative movement that are different from each other in a distance between a center of the wiper and a nozzle that is nearest to the center of the wiper among the at least one nozzle and the distance is longer in the second relative movement than in the first relative movement.

In this aspect, because a portion that cannot be wiped by the first relative movement can be wiped by the second relative movement, it is possible to restrain an unwiped spot from being left on the nozzle surface and therefore restrain an ejection target medium from being stained by a liquid having deposited on and adhered to the unwiped spot.

A liquid ejecting apparatus according to a fifth aspect of the invention includes a liquid ejecting head that has a nozzle surface that is provided with at least one nozzle that ejects a liquid, a wiper that wipes the nozzle surface, a scanning mechanism that causes the nozzle surface and the wiper to perform a plurality of relative movements between the nozzle surface and the wiper, and a controller that controls the scanning mechanism. The plurality of relative movements includes a first relative movement and a second relative movement that are different from each other in number of the at least one nozzles that are wiped and the number of the at least one nozzle that are wiped is greater in the first relative movement than in the second relative movement.

In this aspect, because a portion that cannot be wiped by the first relative movement can be wiped by the second relative movement, it is possible to restrain an unwiped spot from being left on the nozzle surface and therefore restrain an ejection target medium from being stained by a liquid having deposited on and adhered to the unwiped spot.

A liquid ejecting apparatus according to a sixth aspect of the invention includes a liquid ejecting head that has a nozzle surface that is provided with at least one nozzle that ejects a liquid, a wiper that wipes the nozzle surface, a scanning mechanism that causes the nozzle surface and the wiper to perform a plurality of relative movements between the nozzle surface and the wiper, and a controller that controls the scanning mechanism. The plurality of relative movements includes a first relative movement that wipes a central portion of the nozzle surface and a second relative movement that wipes an end portion of the nozzle surface.

In this aspect, because a portion that cannot be wiped by the first relative movement can be wiped by the second relative movement, it is possible to restrain an unwiped spot from being left on the nozzle surface and therefore restrain an ejection target medium from being stained by a liquid having deposited on and adhered to the unwiped spot.

In the foregoing liquid ejecting apparatuses, the second relative movement may have a lower moving speed than the first relative movement. Therefore, the second relative movement at a relatively slow speed will certainly wipe off a liquid that has an increased viscosity. Furthermore, the wiping by the first relative movement at a relatively fast speed will reduce the amount of time in which printing is interrupted.

Furthermore, the second relative movement may involve a higher contact pressure of the wiper on the nozzle surface than the first relative movement. Therefore, the second relative movement with a relatively high contact pressure will certainly wipe off a liquid that has an increased viscosity. Furthermore, the wiping by the first relative movement with a relatively low contact pressure will restrain wear of the wiper and/or a liquid-repellent film formed on the nozzle surface.

Furthermore, in the foregoing liquid ejecting apparatuses, in the first relative movement, a distance between a center of the wiper and a nozzle that is nearest to the center of the wiper among the at least one nozzle may be short and, in the second relative movement, the distance between the center of the wiper and a nozzle that is nearest to the center of the wiper among the at least one nozzle may be longer than in the first relative movement. Therefore, because a portion that cannot be wiped by the first relative movement can be wiped by the second relative movement, it is possible to restrain an unwiped spot from being left on the nozzle surface and therefore restrain an ejection target medium from being stained by a liquid having deposited on and adhered to the unwiped spot.

Furthermore, the first relative movement may wipe a greater number of nozzles than the second relative movement. Therefore, because a portion that cannot be wiped by the first relative movement can be wiped by the second relative movement, it is possible to restrain an unwiped spot from being left on the nozzle surface and therefore restrain an ejection target medium from being stained by a liquid having deposited on and adhered to the unwiped spot.

Furthermore, the first relative movement may wipe a central portion of the nozzle surface and the second relative movement may wipe an end portion of the nozzle surface. Therefore, because a portion that cannot be wiped by the first relative movement can be wiped by the second relative movement, it is possible to restrain an unwiped spot from being left on the nozzle surface and therefore restrain an ejection target medium from being stained by a liquid having deposited on and adhered to the unwiped spot.

Furthermore, the controller may substantially synchronize the wiping by the second relative movement with the wiping by the first relative movement. Therefore, because of the synchronization between the first relative movement and the second relative movement, efficient wiping can be accomplished when a region wiped by the first relative movement and a wiped by the second relative movement are simultaneously stained. Furthermore, since the wiping by the second relative movement is synchronized with the wiping of the first relative movement, the wiping by the second relative movement at a useless time can be avoided and therefore the amount of time in which printing is interrupted can be reduced.

Furthermore, the foregoing liquid ejecting apparatuses may further include a suction unit that sucks the liquid from the at least one nozzles and the controller may the wiping by the second relative movement to be performed, then cause a suction operation by the suction unit to be performed, and then cause the wiping by the first relative movement to be performed. Therefore, when nozzles are wiped by the second relative movement, the suction operation and the wiping by the first relative movement will restore the nozzles.

Furthermore, the foregoing liquid ejecting apparatuses may further include a suction unit that sucks the liquid from the at least one nozzles and the controller may cause suction by the suction unit to be performed, then cause the wiping by the first relative movement to be performed, and then cause the wiping by the second relative movement to be performed. Therefore, since the wiper to which fresh liquid provided by the suction adhered due to the first relative movement is caused to perform the wiping by the second relative movement, a liquid with an increased viscosity can be removed.

Furthermore, the controller may asynchronize the wiping by the second relative movement with the wiping by the first relative movement. Therefore, the wiping by the second relative movement can be performed at a desired time.

Furthermore, in a direction in the nozzle surface which direction is orthogonal to a direction in which the relative movements between the nozzle surface and the wiper are performed, the wiper may be smaller in size than the nozzle surface. Therefore, the wiper can be reduced in size so that the liquid ejecting apparatus can be reduced in size and costs can be reduced.

A wiping method according to still further aspect of the invention is a wiping method for a nozzle surface of a liquid ejecting head, the nozzle surface being provided with at least one nozzle that ejects a liquid. The wiping method includes performing a first wiping that performs a wiping with a wiper for the at least one nozzle of the nozzle surface and a second wiping that performs a wiping with a wiper for a portion of the nozzle surface which is other than the nozzle with the wiper.

In this aspect of the invention, performing the wiping by the first relative movement restores the at least one nozzle. Furthermore, by performing the wiping of a portion other than the at least one nozzle by the second relative movement, it is possible to restrain an unwiped spot from being left in the portion other than the at least one nozzle and therefore restrain an ejection target medium from being stained by the liquid having deposited on and adhered to the unwiped spot.

A wiping method according to a further aspect of the invention is a wiping method for a nozzle surface of a liquid ejecting head, the nozzle surface being provided with at least one nozzle that ejects a liquid. The wiping method includes performing a first wiping and a second wiping that each perform a wiping with a wiper for the at least one nozzle of the nozzle surface. The first wiping and the second wiping are different from each other in a distance between a center of the wiper and a nozzle that is nearest to the center of the wiper among the at least one nozzle and in distance that the wiper and the nozzle surface are moved relatively to each other to wipe the nozzle surface.

In this aspect, because a portion that cannot be wiped by the first relative movement can be wiped by the second relative movement, it is possible to restrain an unwiped spot from being left on the nozzle surface and therefore restrain an ejection target medium from being stained by a liquid having deposited on and adhered to the unwiped spot.

BRIEF DESCRIPTION OF THE DRAWINGS

The invention will be described with reference to the accompanying drawings, wherein like numerals reference like elements.

DESCRIPTION OF EXEMPLARY EMBODIMENTS

The invention will be described hereinafter with reference to exemplary embodiments of the invention.

Exemplary Embodiment 1

Figure 1:
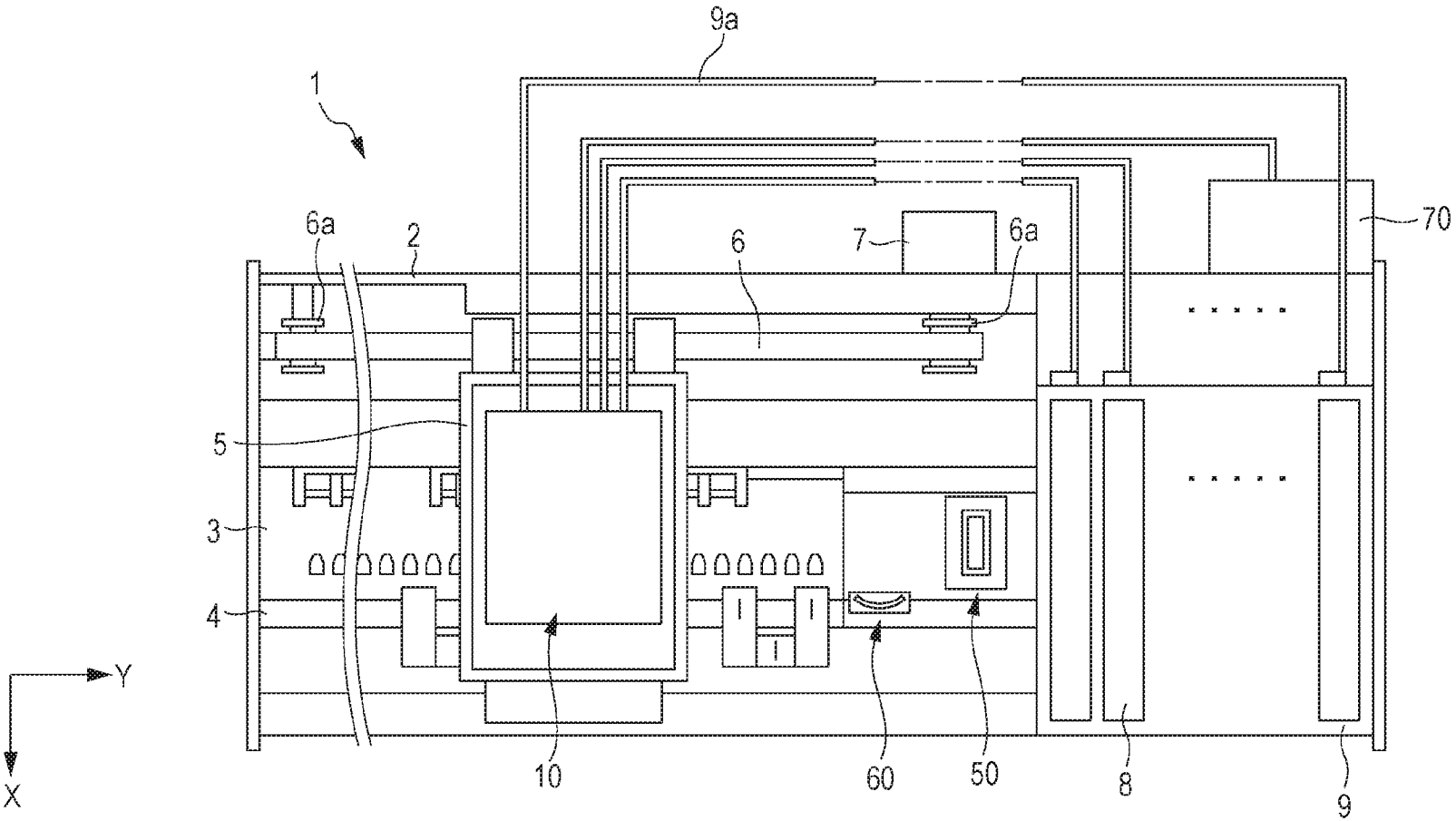
FIG. 1 is a plan view showing a general construction of a recording apparatus according to Exemplary Embodiment 1 of the invention.

FIG. 1 is a schematic perspective view of an ink jet type recording apparatus that is an example of a liquid ejecting apparatus according to Exemplary Embodiment 1 of the invention.

As shown in FIG. 1, an ink jet type recoding apparatus 1 of this exemplary embodiment includes a body frame 2 that is an apparatus body that has a rectangular shape when viewed from above. In the body frame 2, a medium support member 3 that supports an ejection target medium, such as a paper or resin sheet, extends along a second direction Y that is a main scanning direction of the ink jet type recoding apparatus 1. An ejection target medium is fed onto the medium support member 3, along a first direction X that is orthogonal to the second direction Y and that is a subsidiary scanning direction by a sheet feed mechanism (not graphically shown). Furthermore, above the medium support member 3 within the body frame 2 there is suspended a bar-shaped guide shaft 4 extending along the second direction Y with regard to the medium support member 3.

A carriage 5 is supported on the guide shaft 4 so as to be movable back and forth along the guide shaft 4 in the second direction Y. The carriage 5 is connected to a carriage motor 7 that is provided on the body frame 2, via an endless timing belt 6 wrapped around a pair of pulleys **6*a* that are provided on the body frame 2. Therefore, the carriage 5 is moved back and forth in the second direction Y along the guide shaft 4, driven by the carriage motor 7**. Note that a direction that intersects with the first direction X and the second direction Y is termed the third direction Z. Although in this exemplary embodiment, the directions X, Y and Z are assumed to be orthogonal in order to facilitate the understanding of descriptions, the arrangement relations among various configurations and structures are not limited to relations based on such orthogonal directions.

The carriage 5 holds the ink jet type recording head 10 (hereinafter, also referred to simply as "recording head 10") that is an example of the liquid ejecting head of this exemplary embodiment. Although detailed later, a surface of the recording head 10 which faces the medium support member 3 is provided with a plurality of nozzles. By driving pressure generation units (not graphically shown) provided within the recording head 10, ink droplets are ejected from the nozzles to an ejection target medium fed onto the medium support member 3 so that the ink droplets land as dots on the ejection target medium, that is, printing is performed.

A tank holder 9 is provided on an end side of the body frame 2 in the second direction Y. Ink tanks 8 as a liquid supply source are detachably fitted to the tank holder 9. The ink tanks 8 contain mutually different kinds (colors) of inks. In this exemplary embodiment, a plurality of ink tanks 8 corresponding to the kinds of inks to be discharged is provided. The number of ink tanks 8 is not particularly restricted, that is, may be one and may also be two or more.

While the ink tanks 8 are fitted to the tank holder 9, the ink tanks 8 are connected to the recording head 10 via ink supply tubes 9*a*. In this exemplary embodiment, although not particularly graphically shown in the drawings, pressurized feeding units that pressurize and send the inks from the ink tanks 8 toward the recording head 10 are provided on the tank holder 9, intermediate portions of the ink supply tubes 9*a*, or the like. Examples of pressurized feeding units include a pressing unit that presses an ink tank 8 from outside, a pressure pump, etc. Note that the pressurized feeding units may utilize a hydraulic head difference that is created by adjusting the position of the ink tank 8 relative to the recording head 10 in a vertical direction.

In a home position region of the carriage 5 which is located toward one end in the second direction Y within the body frame 2, a suction unit 50 that draws inks or the like from the nozzles of the recording head 10 and a wiping unit 60 that wipes the nozzle surface of the recording head 10 are provided.

Furthermore, as shown in FIG. 1, the body frame 2 is provided with a control apparatus 70 that includes a controller that controls operations of the ink jet type recording apparatus 1.

Figure 2:
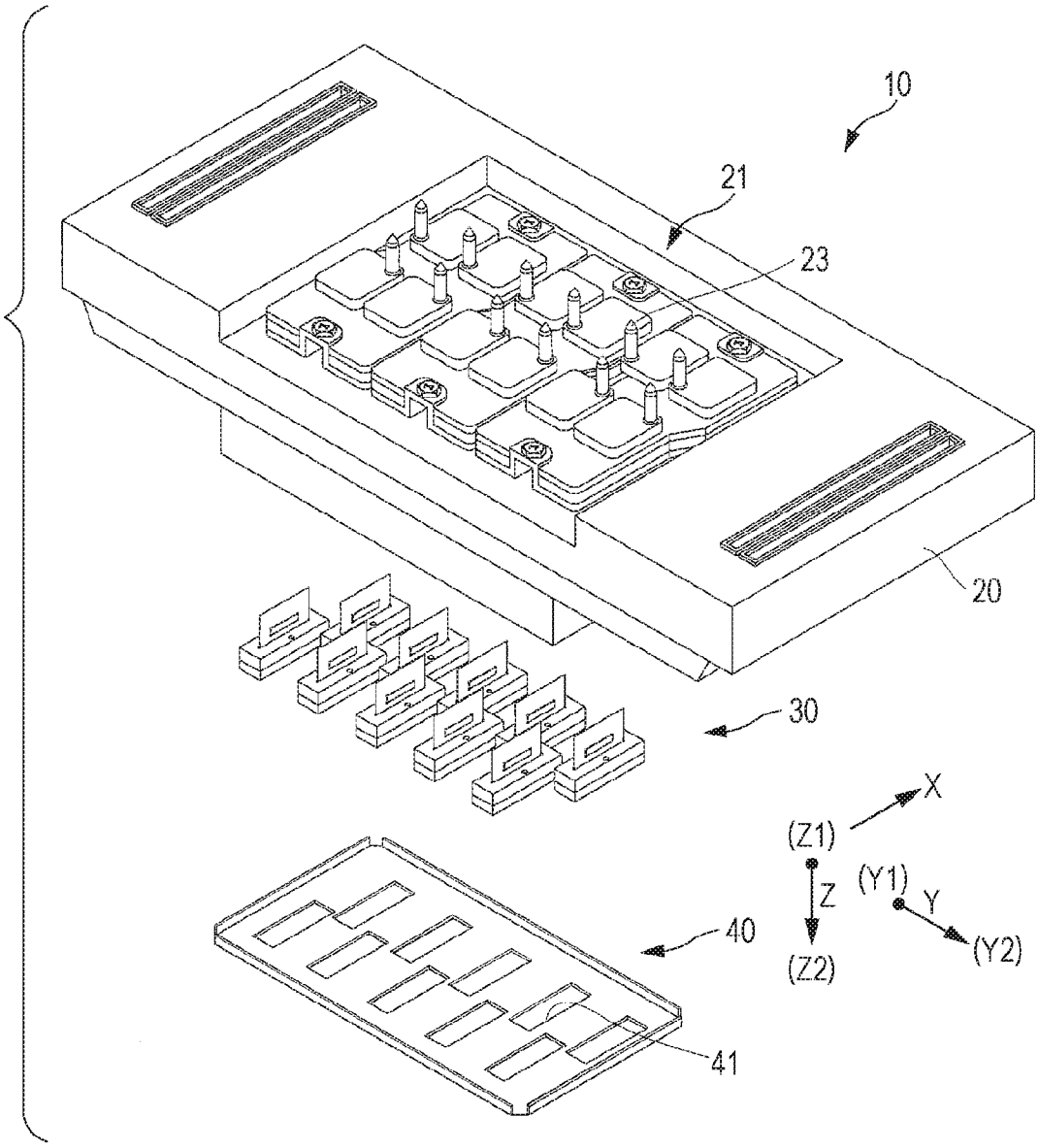
FIG. 2 is an exploded perspective view of a recording head according to Exemplary Embodiment 1 of the invention.
Figure 3:
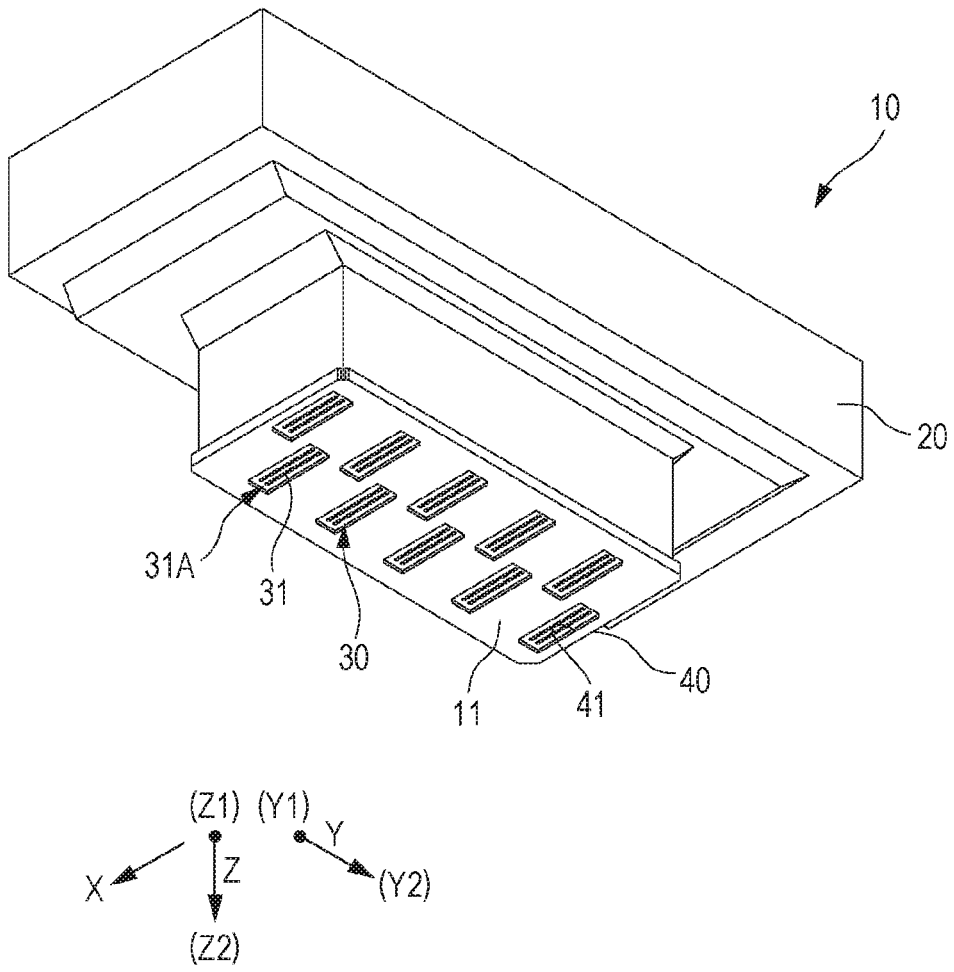
FIG. 3 is a perspective view of the recording head according to Exemplary Embodiment 1.
Figure 4:
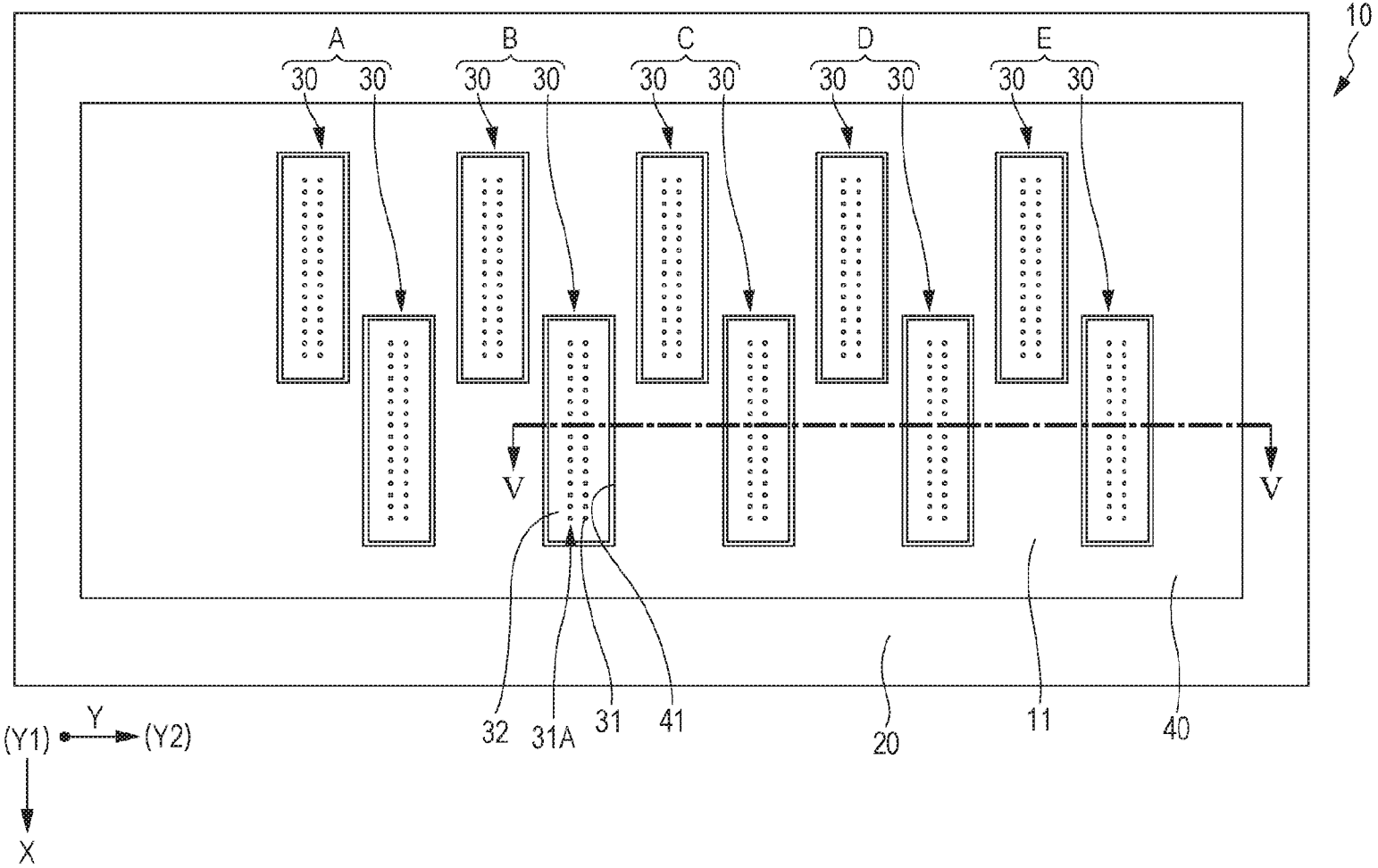
FIG. 4 is a plan view of the recording head according to Exemplary Embodiment 1.
Figure 5:
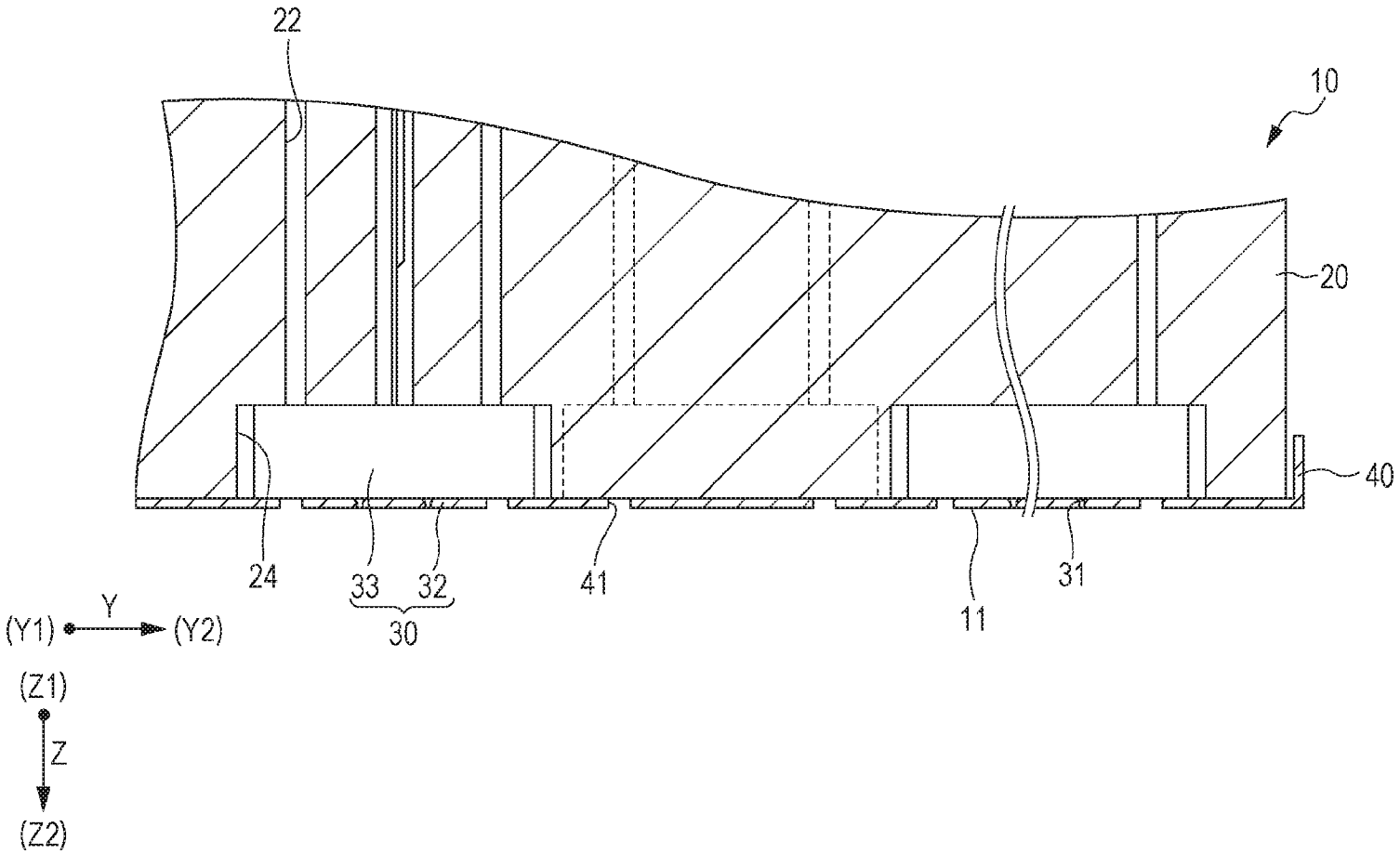
FIG. 5 is a sectional view of portions of a recording head according to Exemplary Embodiment 1.

An example of the recording head 10 mounted in the foregoing ink jet type recording apparatus 1 will be described with reference to FIG. 2 to FIG. 5. Incidentally, FIG. 2 is an exploded perspective view of an ink jet type recording head that is an example of the liquid ejecting head. FIG. 3 is a perspective view of the recording head taken from a nozzle surface side. FIG. 4 is a plan view of the recording head taken from the nozzle surface side. FIG. 5 is a sectional view taken on line V-V in FIG. 4. In the description of this exemplary embodiment, the directions mentioned relative to the recording head 10 are the directions in which the recording head 10 are mounted in the ink jet type recording apparatus 1, that is, the first direction X, the second direction Y, and the third direction Z. However, the disposal of the recording head 10 within the ink jet type recording apparatus 1 is not limited to what is shown below.

As shown in FIGS. 2 to 5, the recording head 10 of the exemplary embodiment includes a flow path holder 20, a plurality of head bodies 30, and a fixture plate 40.

The flow path holder 20 includes a fitting portion 21 to which the ink supply tubes 9*a* extending from the ink tanks 8 (see FIG. 1) that are liquid supply units are connected directly or via, for example, other flow path members that each include a pressure regulation valve or the like. Furthermore, the flow path holder 20, as shown in FIG. 5, is provided with a plurality of ink communication paths 22 each of which has, at an end thereof, an opening in the fitting portion 21 on a Z1 side of the flow path holder 20 in the third direction Z and has, at another end thereof, an opening in a Z2-side surface of the flow path holder 20 in the third direction Z. Furthermore, as can be understood from FIG. 2, ink supply needles 23 are fixed to opening portions of the ink communication paths 22 in the fitting portion 21, via filters (not graphically shown) formed inside the ink communication paths 22 so as to remove bubbles and undesirable substances in ink. The ink supply needles 23 are inserted into the ink supply tubes 9*a* or other flow path members.

Furthermore, as shown in FIG. 5, the Z2-side surface of the flow path holder 20 in the third direction Z which faces the ejection target medium is provided with head body holder portions 24 in each of which a head body 30 can be housed. The head body holder portions 24 have a recess shape that has an opening in the Z2-side surface of the flow path holder 20. In this exemplary embodiment, the head body holder portions 24 are provided separately for each of the head bodies 30. It is also permissible that a head body holder portion 24 be extended so as to house a plurality of head bodies 30. However, if the head body holder portions 24 are provided separately for each head body 30, the rigidity of the flow path holder 20 can be increased and, at the same time, the junction area between the flow path holder 20 and the fixture plate 40 can be increased so as to improve the degree of planarity of the fixture plate 40 and the nozzle plate 32.

A head body 30 is housed in each of the head body holder portions 24 of the flow path holder 20. Each of the head bodies 30 in this exemplary embodiment includes a nozzle plate 32 provided with nozzles 31 that discharge ink droplets and a flow path member 33 provided with flow paths (not graphically shown) that communicate with the nozzles 31.

As shown in FIG. 4, the nozzle plate 32 of each head body 30 is provided with two nozzle rows 31A in each of which nozzles 31 are juxtaposed in the first direction X. The two nozzle rows 31A are juxtaposed in the second direction Y.

In an interior (not graphically shown) of the flow path member 33 of each head body 30 there are provided flow paths that communicated with the nozzles 31 and pressure generation units that cause pressure changes in the ink inside the flow paths so as to discharge ink droplets from the nozzles 31. The pressure generation units may be, for example, piezoelectric actuators that use a piezoelectric material that performs an electromechanical transduction function, units that use heating elements, electrostatic force, or the like.

A plurality of such head bodies 30 is held by the flow path holder 20. Concretely, in the flow path holder 20, two rows of head bodies 30 in each of which five head bodies 30 are juxtaposed in the second direction Y, which is the direction in which the nozzle rows 31A are juxtaposed, are juxtaposed in the first direction X. That is, one recording head 10 holds a total of ten head bodies 30, with a total of twenty nozzle rows 31A juxtaposed in the second direction Y. Two head bodies 30 that eject the same ink are displaced from each other in the first direction X and the two head bodies 30 displaced from each other in the first direction X are overlapped with each other when viewed in the second direction Y so that portions of the nozzle rows 31A of the two head bodies 30 overlap each other when viewed in the second direction Y. Due to this arrangement of the two head bodies 30, the length of the nozzle rows 31A that eject the same ink can be increased in the first direction X. In this exemplary embodiment, on the assumption that two such head bodies 30 juxtaposed in the second direction Y make a group, five groups of head bodies 30 in total are provided in the flow path holder 20. The five groups of head bodies 30 are referred to as group A, group B, group C, group D, and group E in order from a negative direction (Y1) side to a positive direction (Y2) side in the second direction Y.

Furthermore, a fixture plate 40 is fixed to the Z2-side surface of the flow path holder 20 in which each head body holder portion 24 has an opening.

The fixture plate 40 is provided with opening portions 41 that correspond one-to-one to the head bodies 30 and that each expose the nozzle plate 32 of a corresponding one of the head bodies 30. Specifically, in this exemplary embodiment, the fixture plate 40 has ten opening portions 41. In this exemplary embodiment, the opening portions 41 each have an opening that is larger than the nozzle plates 32 and a gap is provided between each nozzle plate 32 and the surface of the fixture plate 40. It is also permissible that the opening of each opening portion 41 be smaller than the nozzle plates 32 and the fixture plate 40 be joined to the nozzle plates 32 directly or via other members.

Furthermore, the fixture plate 40 is joined to each head body 30 at a portion other than the nozzle plate 32 and is fixed to the Z2-side surface of the flow path holder 20, more specifically, a perimeter portion of the opening of each head body holder portion 24, by an adhesive or the like.

In the recording head 10 configured as described above, the Z2-side surface of the fixture plate 40 and the Z2-side surfaces of the nozzle plates 32 define a nozzle surface 11. The nozzle surface 11 of the recording head 10 is positioned so as to face the recording sheet S during printing. In this exemplary embodiment, because the head bodies 30 are fixed at the Z1-side surface of the fixture plate 40, the heights of the nozzle plates 32 of the head bodies 30 in the third direction Z can be easily made equal and therefore print quality can be improved.

Figure 6:
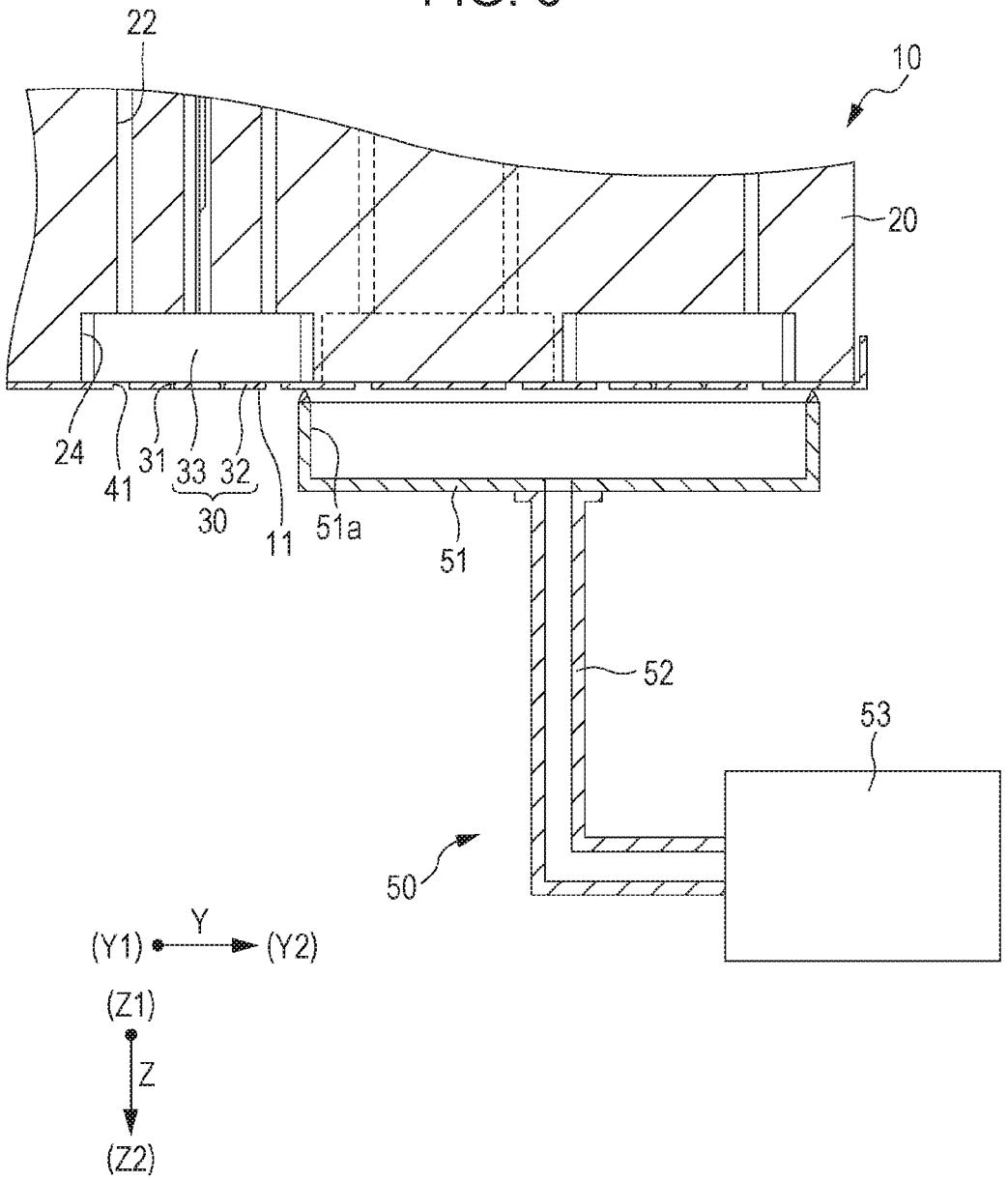
FIG. 6 is a sectional view showing a general configuration of a suction unit according to Exemplary Embodiment 1.

The suction unit 50 in this exemplary embodiment will be described with reference to FIG. 6. FIG. 6 is a sectional view showing a general configuration of the suction unit 50 in this exemplary embodiment.

As shown in FIG. 6, the suction unit 50 includes a cap member 51 that covers nozzles 31 of the recording head 10 and a suction device 53, such as a vacuum pump, that is connected to the cap member 51 via a suction pipe 52 such as a tube.

The cap member 51 in this exemplary embodiment has such a size as to cover the nozzle rows 31A of each of the groups A to E of head bodies 30 of the recording head 10. Specifically, the cap member 51 has such a size as to simultaneously cover all the nozzles 31 of the two head bodies 30 in each one of the groups A to E. This configuration, compared with a configuration that employs a cap member that has such a size as to simultaneously cover all the nozzles 31 of the recording head 10, that is, the nozzles 31 of the ten head bodies 30, allows the cap member 51 to be reduced in size and therefore allows a size reduction of the ink jet type recording apparatus 1 and therefore a cost reduction thereof. Furthermore, because the cap member 51 covers the nozzles 31 separately for each of the groups A to E, it is possible to cap and suck only the nozzle rows 31A that have ejected ink droplets using the cap member 51. Thus, wasteful consumption of ink can be restrained. Furthermore, because the size of the cap member 51 is reduced, it becomes possible to perform the suction with a large suction force even if the suction device 53 is able to generate only a small suction pressure. Therefore, a size reduction of the suction device 53 can also be pursued.

However, the cap member 51 is not particularly limited to this configuration but may also be, for example, a cap member that has such a size as to simultaneously cover all the nozzles 31 of the recording head 10, that is, the nozzles 31 of the ten head bodies 30.

In the suction unit 50 described above, after an opening edge portion of a suction opening 51*a* of the cap member 51 is brought into contact with the nozzle surface 11, the suction device 53 is caused to perform a suction operation of generating a negative pressure within the cap member 51 and therefore drawing ink together with bubbles and the like in the flow path from nozzles 31 of the recording head 10. Incidentally, the suction operation is performed at predetermined times, for example, before printing, after printing, after the elapse of a predetermined amount of time, etc.

Figure 7:
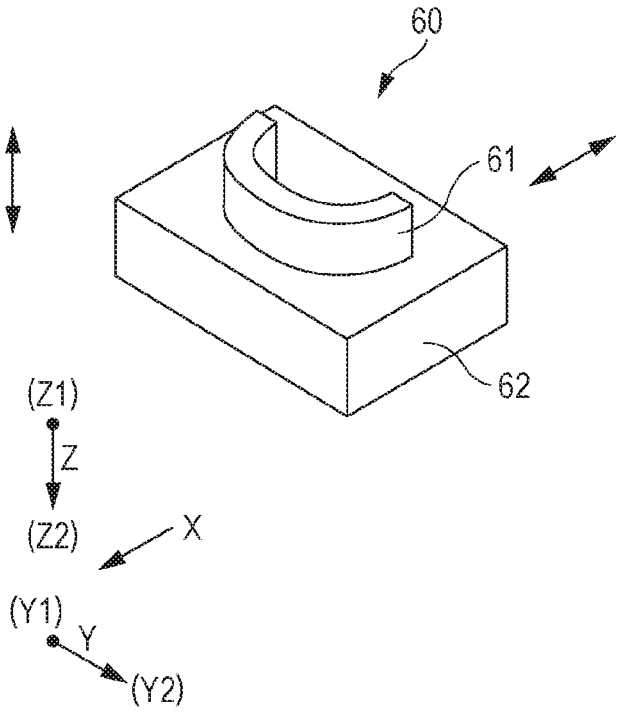
FIG. 7 is a perspective view of a wiper according to Exemplary Embodiment 1.
Figure 8:
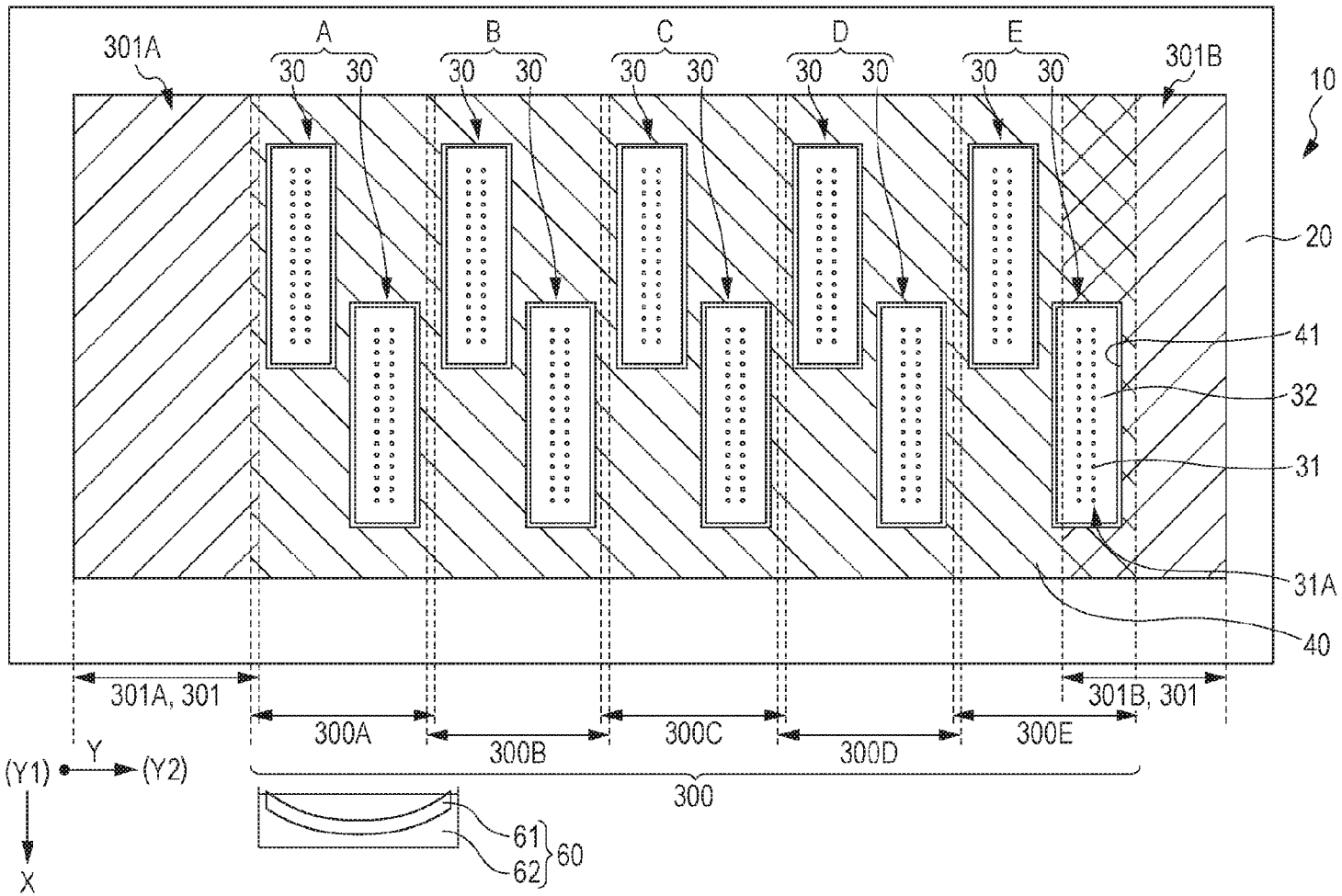
FIG. 8 is a plan view of the recording head and the wiper according to Exemplary Embodiment 1.

A wiping unit 60 in the exemplary embodiment will be described with reference to FIG. 7 and FIG. 8. FIG. 7 is a perspective view showing the wiping unit 60. FIG. 8 is a plan view showing the recording head 10 and the wiping unit 60.

As shown in FIGS. 7 and 8, the wiping unit 60 in this exemplary embodiment has a wiper 61 that wipes the nozzle surface 11 and a wiper holder portion 62 that holds the wiper 61.

The wiper 61 in this exemplary embodiment is made up of a platy member formed from an elastic member such as a rubber or an elastomer. The wiper 61 is fixed, at its proximal end portion, to the wiper holder portion 62 so that a distal end of the wiper 61 is a free end. Furthermore, the wiper 61 is disposed so that its distal end that is a free end is protruded toward the nozzle surface 11, that is, to the Z1 side, and so that a direction along a surface of the distal end is the second direction Y. Further, the wiper 61 in this exemplary embodiment is curved into a bow shape with respect to a straight line in the second direction Y so that a surface of the wiper 61 forms a recess shape.

The recording head 10 of the wiper holder portion 62 that holds the wiper 61 is provided so as to be relatively movable in the third direction Z by a drive unit (not graphically shown). This makes it possible to bring the distal end of the wiper 61 into and out of contact with the nozzle surface 11 of the recording head 10. Furthermore, the wiper holder portion 62 is provided so as to be movable in the first direction X by a scanning mechanism that employs a combination of a driving motor, a gear, etc. (which are not graphically shown). This makes it possible to wipe the nozzle surface 11 with the distal end of the wiper 61 being in a sliding contact with the nozzle surface 11.

The wiper 61 configured as described above is, as shown in FIG. 8, shorter than a measure of the nozzle surface 11 in the second direction Y orthogonal to the first direction X, which is the direction in which the wiper 61 is moved relatively to the nozzle surface 11 during wiping. In this exemplary embodiment, the width of the wiper 61 in the second direction Y has such a size as to cover the nozzle rows 31A of the two head bodies 30 in each of the groups A to E. That is, the wiper 61 has such a width that, by performing one movement in the first direction X, the wiper 61 can pass over and wipe all the four nozzle rows 31A of the two head bodies 30 of a given one of the groups A to E. In this exemplary embodiment, the width of the wiper 61 in the second direction Y has such a size as to enable the simultaneous wiping of the nozzle plates 32 of the two head bodies 30 of any one of the groups A to E. Furthermore, in this exemplary embodiment, the measure of the wiper 61 in the second direction Y has such a size that, when the wiper 61 has wiped mutually adjacent ones of the groups A to E, portions of the wiped regions in the nozzle surface 11 overlap each other. Therefore, occurrence of an unwiped non-head region between the groups A to E can be restrained when all the groups A to E are wiped by the wiper 61.

In this exemplary embodiment, the regions that are wiped by the wiper 61 when the groups A to E are wiped are referred to as head regions 300A to 300E. Furthermore, in this exemplary embodiment, the head regions 300A to 300E are collectively referred to as the head region 300 as well. The nozzle surface 11 further includes non-head regions 301 that are not wiped when the wiping of the groups A to E is performed. That is, the non-head regions 301 are portions of the nozzle surface 11 that are other than the head region 300 that is wiped by the wiping performed for the groups A to E. In this exemplary embodiment, the head regions 300A to 300E are set in a central portion of the nozzle surface 11 in the second direction Y and the non-head regions 301 are set on both sides of the head regions 300A to 300E (both sides of the head region 300) in the second direction Y, that is, in two end portions of the nozzle surface 11 in the second direction Y. In this exemplary embodiment, of the two non-head regions 301, a region set at the Y1 side of the nozzle surface 11 that is one side thereof in the second direction Y is referred to as a first non-head region 301A and the region set at the Y2 side of the nozzle surface 11 that is the other side thereof in the second direction Y is referred to as a second non-head region 301B. The second non-head region 301B is narrower in the second direction Y than the first non-head region 301A and the wiper 61. Therefore, although detailed later, the wiping of the second non-head region 301B by the wiper 61 also wipes the nozzles 31 of the Y2-side head body 30 of the two head bodies 30 that constitute the group E. Furthermore, the first non-head region 301A in this exemplary embodiment has a width in the second direction Y that is slightly smaller than the width of the wiper 61 and that is such a width that, when the first non-head region 301A is wiped, the nozzles 31 in the head region 300A are left unwiped. It is also permissible that the first non-head region 301A have a larger width in the second direction Y than the wiper 61. In the case where the first non-head region 301A has a larger width in the second direction Y than the wiper 61, it suffices that the first non-head region 301A is wiped by the wiper 61 a plurality of times, that is, more than once. Furthermore, if, at the time of wiping the second non-head region 301B, the wiper 61 is displaced to the opposite side to the head region 300E, it is possible to avoid wiping the nozzles 31 of the head body 30 in the group E adjacent to the second non-head region 301B.

Figure 9:
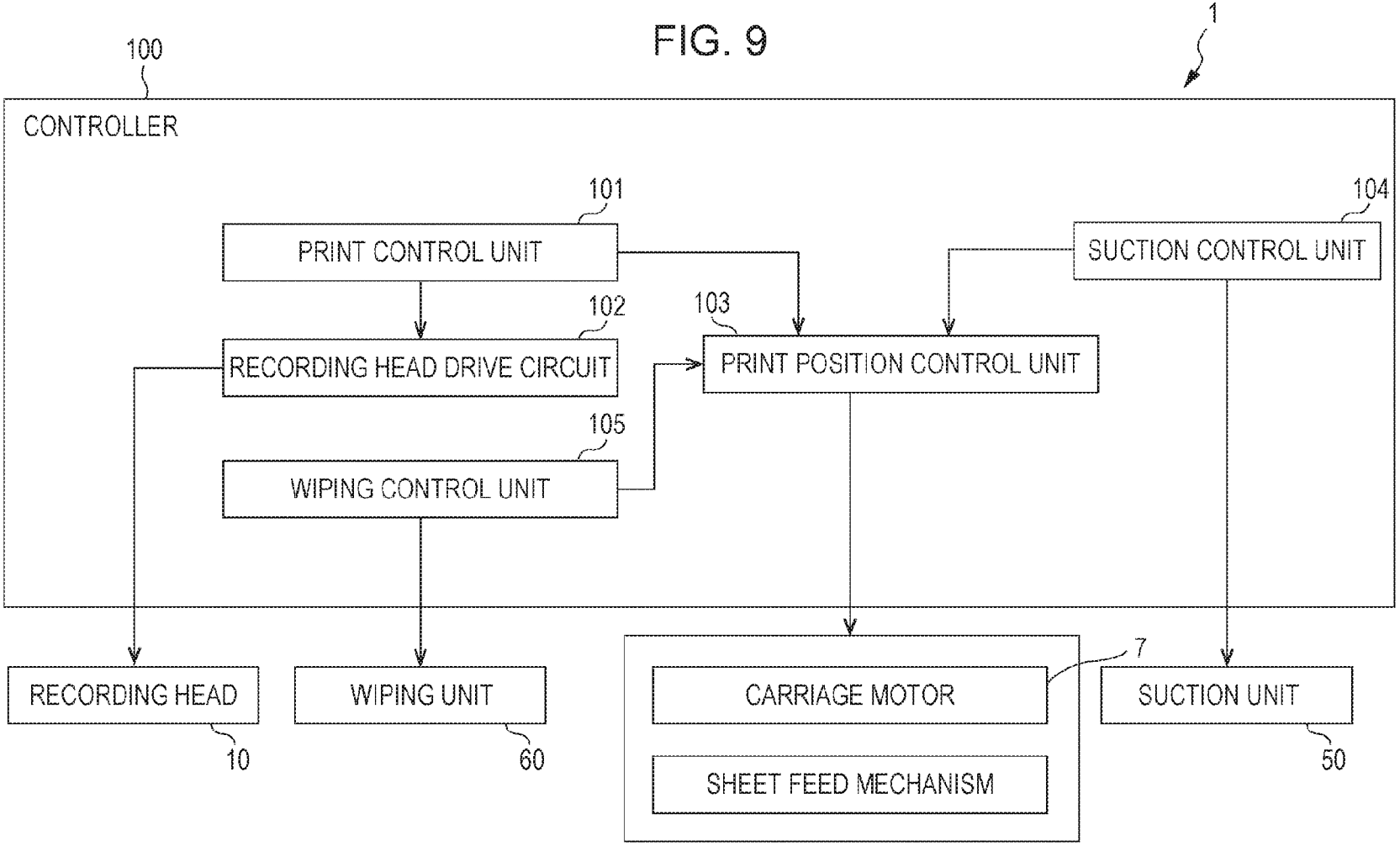
FIG. 9 is a functional block diagram illustrating a control system according to Exemplary Embodiment 1.

An electrical configuration of the ink jet type recording apparatus 1 of the exemplary embodiment will be described in detail with reference to FIG. 9. FIG. 9 is a functional block diagram illustrating an electrical configuration of the ink jet type recording apparatus 1.

As shown in FIG. 9, the ink jet type recording apparatus 1 includes the recording head 10 that is a mechanism portion that performs actual printing, the suction unit 50 that draws ink from the nozzles 31 of the recording head 10, the wiping unit 60 that wipes the nozzle surface 11 of the recording head 10, and a controller 100 that controls operations of the recording head 10, the suction unit 50, and the wiping unit 60.

The controller 100 includes a print control unit 101, a recording head drive circuit 102, a print position control unit 103, a suction control unit 104, and a wiping control unit 105. Note that the controller 100 includes, for example, a CPU and a storage that stores control programs and the like, and realizes various functions by causing the CPU to execute the control programs. Incidentally, the control programs are read from a storage medium, such as a floppy disk, a CD-ROM, a DVD-ROM, or a USB memory, that is connected to the controller 100 directly or via a host computer. The control programs may also be provided as a printer driver in the host computer. In the case where the control programs are provided in the host computer, the controller mentioned in the appended claims refers to a host computer that is provided with the control programs.

The print control unit 101 controls the printing operation of the recording head 10. For example, the print control unit 101 drives, as a print signal is input, pressure generation units via the recording head drive circuit 102 so that corresponding ones of the nozzles 31 of the recording head 10 discharge ink in the form of ink droplets.

The print position control unit 103 performs the positioning of the recording head 10 in the first direction X and the second direction Y at the times of printing, suction, wiping, etc. In more details, the print position control unit 103 drives the carriage motor 7 to move the carriage 5 in the second direction Y so that the recording head 10 is positioned in the second direction Y, and drives the sheet feed mechanism to move the ejection target medium in the first direction X so that the recording head 10 is positioned in the first direction X relative to the ejection target medium. During printing, the print position control unit 103 moves the recording sheet S in the first direction X while moving the carriage 5 on which the recording head 10 has been mounted, in the second direction Y. Furthermore, during a stop of printing or during suction or wiping, the print position control unit 103 moves the carriage 5 on which the recording head 10 has been mounted to a suction unit 50 side or a wiping unit 60 side in the home position region.

The suction control unit 104 controls the suction operation of the suction unit 50. Specifically, the suction control unit 104 brings the cap member 51 into contact with the nozzle surface 11 at predetermined times and operates the suction device 53 so that the suction unit 50 performs a suction operation of drawing ink or gas from the flow paths of the recording head 10. More specifically, the suction control unit 104 causes the suction operation by, via the print position control unit 103, moving the recording head 10 to a position at which the nozzle surface 11 of the recording head 10 faces the cap member 51 and by causing the cap member 51 to cap the nozzle surface 11 and driving the suction device 53.

This suction operation by the suction control unit 104 is performed at predetermined times, such as the time of cleaning whereby the nozzle surface 11 is cleaned before and after printing, the time of initial filling whereby the flow paths of the recording head 10 are filled with ink for the first time, and the time of replacing any of the ink tanks 8.

The wiping control unit 105 controls the wiping performed by the wiping unit 60. Specifically, the wiping control unit 105, using the print position control unit 103, moves the recording head 10 to a position at which the nozzle surface 11 of the recording head 10 faces the wiper 61 and then, while keeping the wiper 61 in contact with the nozzle surface 11, controls the scanning mechanism (not graphically shown) so as to move the wiper 61 in the first direction X, so that the wiper 61 wipes the nozzle surface 11.

Note that the wiping control unit 105 performs the wiping by causing the wiper 61 and the nozzle surface 11 to move relative to each along the first direction X a plurality of times. In this exemplary embodiment, such a plurality of relative movements between the wiper 61 and the nozzle surface 11 caused by the wiping control unit 105 as mentioned above includes a first relative movement and a second relative movement whose conditions are different from each other. Conditions that make the first relative movement and the second relative movement different from each other are shown in Table 1 below.

TABLE 1

| | First relative movement | Second relative movement |
|---|---|---|
| Condition 1 | Nozzles are wiped. | Something other than nozzles is wiped. |

TABLE 1-continued

| | First relative movement | Second relative movement |
|---|---|---|
| Condition 2 | The distance between the center of the wiper and the nearest nozzle to the center of the wiper is short. | The distance between the center of the wiper and the nearest nozzle to the center of the wiper is long. |
| Condition 3 | The number of nozzles wiped is large. | The number of nozzles wiped is small. |
| Condition 4 | A center of the nozzle surface is wiped. | An end portion of the nozzle surface is wiped. |
| Condition 5 | The moving speed is slow. | The moving speed is fast. |
| Condition 6 | The contact pressure of the wiper on the nozzle surface is low. | The contact pressure of the wiper on the nozzle surface is high. |

It is permissible that the conditions 1 to 6 be satisfied independently of each other and also that two or more of the conditions 1 to 6 be simultaneously satisfied. The conditions 1 to 6 will be described in detail below.

Condition 1

The condition 1 is that the first relative movement wipes the nozzle 31 whereas the second relative movement wipes something other than the nozzles 31.

Concretely, the first relative movement in the condition 1 is, for example, a relative movement that wipes the aforementioned head regions 300A to 300E shown in FIG. 8.

On the other hand, the second relative movement in the condition 1 is a relative movement that wipes the first non-head region 301A.

Note that when the second non-head region 301B is wiped, the nozzle rows 31A of the Y2-side head body 30 of the two head bodies 30 of the group E are also simultaneously wiped and therefore the relative movement that wipes the second non-head region 301B is a first relative movement. In the case where when the second non-head region 301B is to be wiped, the wiper 61 is displaced to the opposite side to the head region 300E so that the nozzles 31 of the adjacent head body 30 in the group E will not be wiped, the relative movement that wipes the second non-head region 301B is a second relative movement.

Condition 2

The condition 2 is that the first relative movement is a wiping movement in which the distance between a center of the wiper 61 and the nozzle 31 nearest to the center of the wiper 61 is short whereas the second relative movement is a wiping movement in which the distance between the center of the wiper 61 and the nearest nozzle 31 to the center of the wiper 61 is longer than in the first relative movement.

Figure 10:
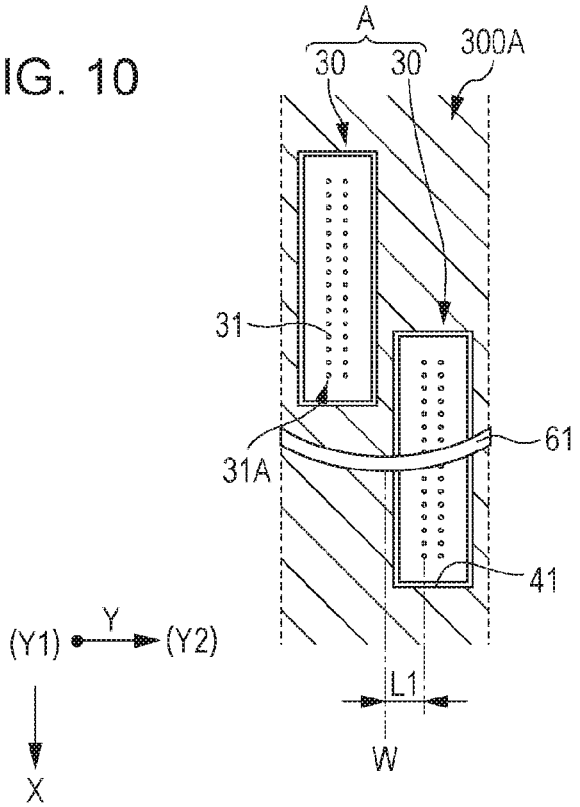
FIG. 10 is a plan view illustrating a condition according to Exemplary Embodiment 1.
Figure 11:
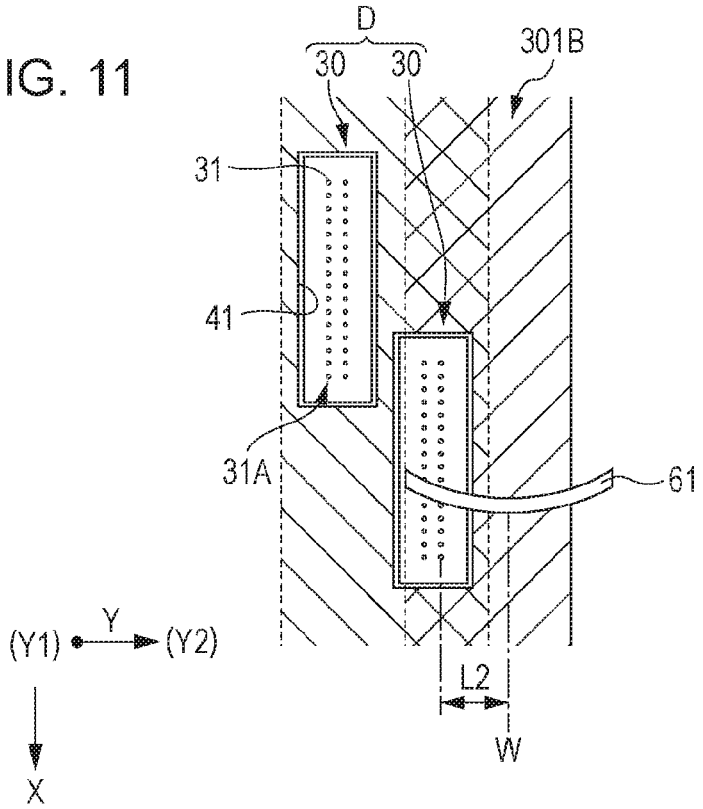
FIG. 11 is a plan view illustrating another condition according to Exemplary Embodiment 1.

Note that, for example, when the wiper 61 wipes each of the head regions 300A to 300E as shown in FIG. 10, the distance L1 in the second direction Y between the center W of the wiper 61 and the nearest nozzle 31 to the center W of the wiper 61 is short. On the other hand, when the wiper 61 wipes the second non-head region 301B as shown in FIG. 11, the distance L2 between the center W of the wiper 61 and the nearest nozzle 31 to the center W of the wiper 61 in the second direction Y is longer than the distance L1 indicated in FIG. 10. Incidentally, when wiping the first non-head region 301A, the wiper 61 does not wipe the nozzles 31, so that the distance between the center of the wiper 61 and the nearest nozzle 31 is longer than the distance L2 indicated in FIG. 11.

Therefore, the movements that wipe the head regions 300A to 300E correspond to the first relative movement and the movements that wipe the non-head regions 301 correspond to the second relative movement.

Condition 3

The condition 3 is that, in the first relative movement, the number of nozzles 31 wiped is large whereas, in the second relative movement, the number of nozzles 31 wiped is small. Not that the case where the number of nozzles 31 wiped is small includes the case where the number of nozzles 31 wiped is null, that is, zero.

Concretely, the number of nozzles 31 that are wiped at the time of wiping any one of the head regions 300A to 300E is a total number of nozzles 31 of the two head bodies 30 that constitute each group. On the other hand, the number of nozzles 31 wiped at the time of wiping the first non-head region 301A is zero. Furthermore, in this exemplary embodiment, the number of nozzles 31 wiped at the time of wiping the second non-head region 301B is less than the total number of nozzles 31 wiped at the time of wiping a given one of the head regions 300A to 300E because the nozzles 31 that are wiped at the time of wiping the second non-head region 301B are only the nozzles 31 of the Y2-side head body 30 of the two head bodies 30 that constitute the group E. Therefore, in Exemplary Embodiment 1 described above, the movements that wipe any one of the head regions 300A to 300E correspond to the first relative movement and the movements that wipe the non-head regions 301 correspond to the second relative movement.

Condition 4

The condition 4 is that the first relative movement wipes the center of the nozzle surface 11 in the second direction Y whereas the second relative movement wipes an end portion of the nozzle surface 11 in the second direction Y.

In this exemplary embodiment, a central portion of the nozzle surface 11 in the second direction Y is provided with the head regions 300A to 300E and portions at both sides of the head regions 300A to 300E are provided with the first non-head region 301A and the second non-head region 301B. Therefore, the movements that wipe the head regions 300A to 300E correspond to the first relative movement and the movements that wipe the non-head regions 301 correspond to the second relative movement.

Note that although in Exemplary Embodiment 1 described above, the non-head regions 301 are provided in both side portions of the nozzle surface 11 in the second direction Y, that is, in two end portions of the nozzle surface 11, this is not restrictive; for example, a non-head region may be provided in a central portion of the nozzle surface 11. In this case, the movements that wipe the non-head region provided in a central portion of the nozzle surface 11 constitute the second relative movement.

Condition 5

The condition 5 is that the first relative movement is a movement in which the wiper 61 moves relatively to the nozzle surface 11 at a high speed whereas the second relative movement is a movement in which the moving speed is lower than in the first relative movement.

Note that the head regions 300A to 300E are regions in which the ink adhering to the nozzle surface 11 due to the discharge of ink droplets from the groups A to E or the suction operation performed by the suction unit 50 is wiped off to recover ink meniscuses in the nozzles 31. Therefore, when the head regions 300A to 300B are wiped, it is preferable that the relative moving speed of the wiper 61 be high. Hence, the amount of time of wiping before printing starts and the amount of time of wiping during printing are reduced, so that the amount of time during which printing is interrupted can be reduced. On the other hand, the non-head regions 301 are prone to adhesion of fuzz or dust and also adhesion of ink droplets resulting in increased viscosity of the ink. Therefore, as for the wiping of the non-head regions 301, it is preferable that the moving speed be low to certainly wipe off the ink with increased viscosity. Furthermore, the non-head regions 301 have less influence on printing and allow the frequency of wiping to be less than the head regions 300A to 300E. Therefore, reducing the relative moving speed of the wiper 61 for the non-head regions 301 is unlikely to affect the amount of time in which printing is interrupted.

Consequently, in this exemplary embodiment, the head regions 300A to 300E are wiped by the first relative movement whose relative moving speed is relatively high and the non-head regions 301 are wiped by the second relative movement whose relative moving speed is relatively low.

Condition 6

The condition 6 is that the first relative movement is a movement in which the pressure at which the wiper 61 contacts the nozzle surface 11 is low whereas the second relative movement is a movement in which the pressure at which the wiper 61 contacts the nozzle surface 11 is higher than in the first relative movement.

Figure 12:
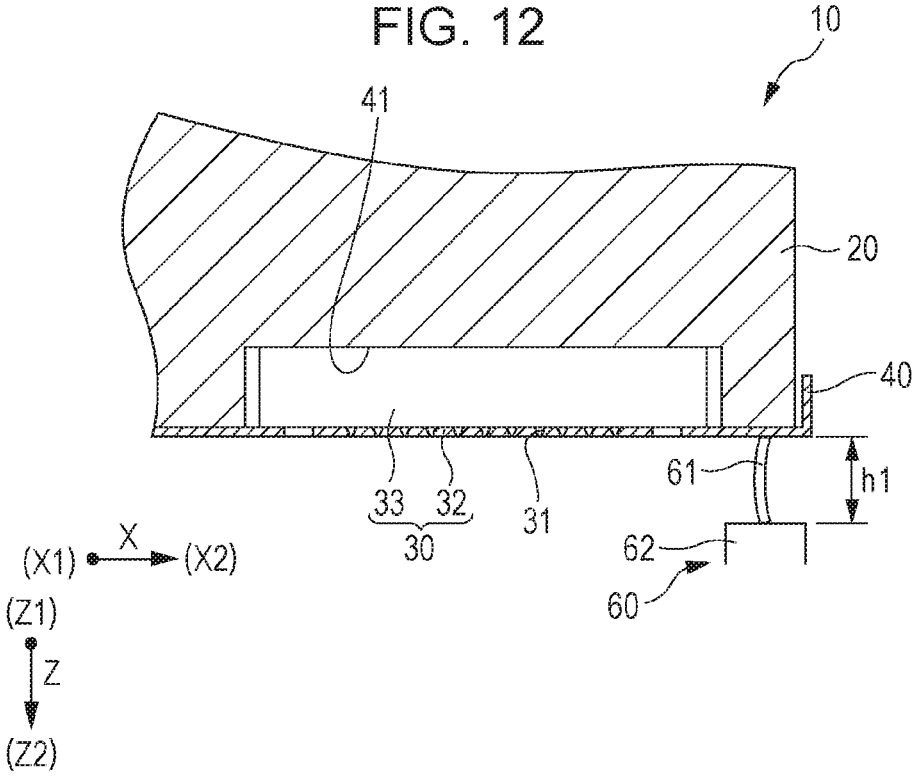
FIG. 12 is a sectional view illustrating still another condition according to Exemplary Embodiment 1.
Figure 13:
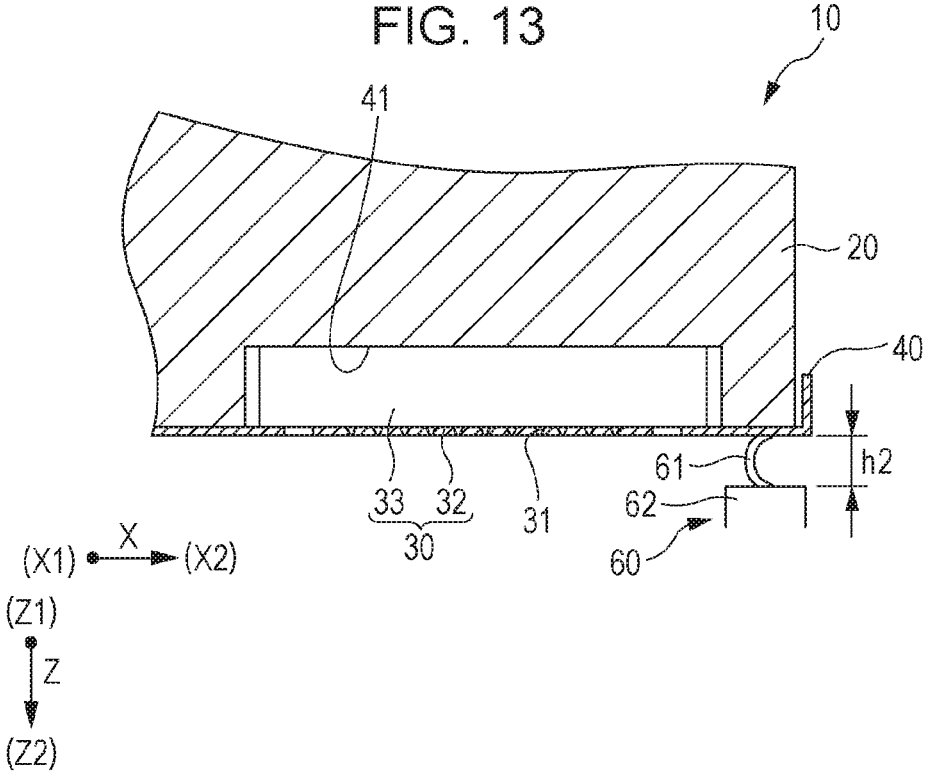
FIG. 13 is a sectional view illustrating yet another condition according to Exemplary Embodiment 1.

Concretely, in the first relative movement, the wiper 61 moves, as shown in FIG. 12, with a distance h1 kept between a proximal end portion of the wiper 61, that is, a nozzle surface 11-side surface of the wiper holder portion 62, and the nozzle surface 11 whereas in the second relative movement, the wiper 61 moves, as shown in FIG. 13, with the distance between the proximal end portion of the wiper 61 and the nozzle surface 11 being a distance h2 that is shorter than the distance h1. Because of this, the second relative movement has a larger amount of interference of the wiper 61 with the nozzle surface 11 and therefore a higher contact pressure.

Incidentally, when the head region 300 is wiped, it is preferable that the contact pressure of the wiper 61 on the nozzle surface 11 be low. This is because the ink adhering to the head regions 300A to 300B is relatively fresh and therefore has not yet increased in viscosity, the nozzle surface 11 can be appropriately wiped even if the contact pressure of the wiper 61 on the nozzle surface 11 is relatively low. Furthermore, making the contact pressure of the wiper 61 on the nozzle surface 11 relatively low will restrain the wear of the wiper 61 or a liquid-repellent film (not graphically shown) formed on the nozzle surface 11. The non-head regions 301, on the other hand, are prone to adhesion of fuzz and dust and adhesion of ink droplets resulting in increased viscosity of ink. Therefore, in the wiping of the non-head regions 301, it is preferable that the contact pressure of the wiper 61 on the nozzle surface 11 be higher than in the wiping of the head region 300, so as to certainly wipe off the ink whose viscosity has increased. Thus, in this exemplary embodiment, the head region 300 is wiped by the first relative movement in which the contact pressure of the wiper 61 is relatively low and the non-head regions 301 are wiped by the second relative movement in which the contact pressure of the wiper 61 is relatively high.

By performing wiping under one or a combination of two or more of the foregoing conditions 1 to 6, the efficient wiping of the head region 300 and the non-head regions 301 can be accomplished. Specifically, portions that cannot be wiped by the first relative movement of wiping can be wiped by the second relative movement of wiping. In particular, the wiping of the non-head regions 301 of the nozzle surface 11 will wipe off and remove the fuzz, dust, and ink adhering to the non-head regions 301. Therefore, it is possible to substantially prevent incidents in which ink adhering to a non-head region 301 contacts and stains an ejection target medium or ink residing on a non-head region 301 drops at an unpredicted time and stains an ejection target medium.

Furthermore, the wiping by the second relative movement that is caused by the wiping control unit 105 on one of or a combination of two or more of the conditions 1 to 6 may be synchronized with the first relative movement or may also be not synchronized or be asynchronized with the first relative movement.

Note that synchronizing the wiping by the second relative movement with the wiping by the first relative movement means that the wiping by the second relative movement is timed closely with the wiping by the first relative movement. That is, it means that the wiping by the second relative movement is performed before or after the wiping by the first relative movement is performed.

In the case where the wiping by the second relative movement is synchronized with the wiping by the first relative movement, it is preferable that, for example, the wiping by the second relative movement be performed on a region adjacent to the region on which the wiping by the first relative movement with which the wiping by the second relative movement is synchronized is performed. Concretely, for example, when the first non-head regions 301A is to be wiped by the second relative movement, the second relative movement is synchronized with the first relative movement that wipes the head region 300A adjacent to the first non-head region 301A. Note that the first non-head region 301A is prone to adhesion of mist of the ink ejected from the nozzles 31 of the group A, which is adjacent to the first non-head region 301A. Then, basically, the wiping of the head region 300A is timed with the discharge of ink droplets from the head bodies 30 of the group A. Therefore, if the wiping of the first non-head region 301A by the second relative movement is synchronized with the wiping of the head region 300A of the group A by the first relative movement, the wiping of the first non-head region 301A can be efficiently performed because of being timed closely with the adhesion thereto of ink ejected from the head bodies 30 of the group A. On another hand, for example, when the head bodies 30 of the group C discharge ink droplets, ink mist is unlikely to deposit on and adhere to the first non-head region 301A. Therefore, if the wiping of the first non-head region 301A by the second relative movement is synchronized with the wiping of the head region 300C by the first relative movement, the first non-head region 301A wiped by the second relative movement does not have much ink adhered, resulting in degraded efficiency with increased wear of the nozzle surface 11 and the wiper 61. The same applies to the second non-head region 301B.

On the other hand, asynchronizing the wiping by the second relative movement with the wiping by the first relative movement means causing the wiping by the second relative movement to be performed with timing different from (or independent of) the timing with which the wiping by the first relative movement is performed. Specifically, it suffices that the wiping by the second relative movement is performed, for example, when the ink jet type recording apparatus 1 is powered on or off or when the accumulated time of printing, the number of sheets printed, the number of back and forth movements of the carriage 5, the number of ink droplets shot, the amount of ink consumed, etc. reaches a predetermined value. The asynchronized timing with which the wiping by the second relative movement is performed may be based on any one of or any combination of two or more of the foregoing conditions concerning the timing.

It is of course permissible that the wiping by the second relative movement be synchronized with the wiping by the first relative movement and, in addition, be performed with asynchronized timing as mentioned above.

Figure 14:
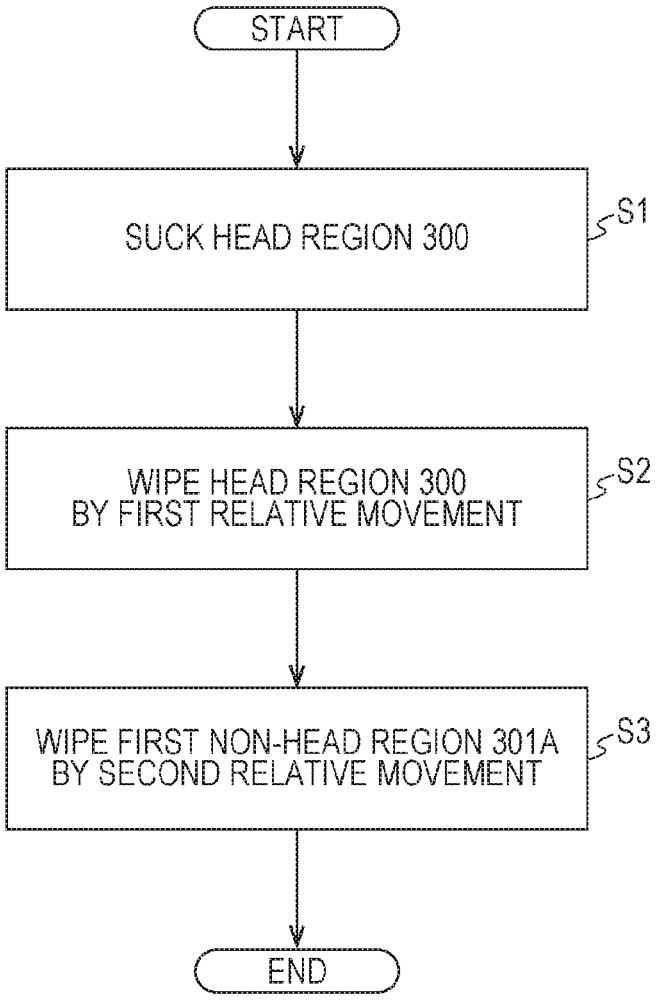
FIG. 14 is a flowchart illustrating a wiping operation according to Exemplary Embodiment 1.

An example of an operation of wiping the first non-head region 301A will be described with reference to FIG. 14. FIG. 14 is a flowchart illustrating a wiping operation.

First, in step S1, the head region 300 is sucked by the suction unit 50. The suction of the head region 300 is performed, for example, selectively on one or more of the groups A to E that have a head body that has discharged ink droplets. This restrains or reduces wasteful consumption of ink.

Next, in step S2, the head region 300 having been sucked by the suction unit 50 is wiped by the wiping unit 60 performing the first relative movement. This recovers meniscuses of ink in the nozzles 31 after breakage thereof due to suction by the suction unit 50 and removes from the head region 300 ink having deposited on and adhered to the head region 300 due to ink mist produced at the time of discharging ink droplets or due to suction by the suction unit 50.

Next, in step S3, the first non-head region 301A is wiped by the wiping unit 60 performing the second relative movement. This removes fuzz, dust, and ink having deposited on and adhered to the first non-head region 301A. Furthermore, the wiping by the first relative movement performed following the suction operation results in fresh ink adhering to the wiper 61. Therefore, since the wiper 61 with fresh ink adhering thereto wipes the first non-head region 301A by the second relative movement, the effect of wiping improves and, in particular, ink with increased viscosity can be more effectively removed.

Figure 15:
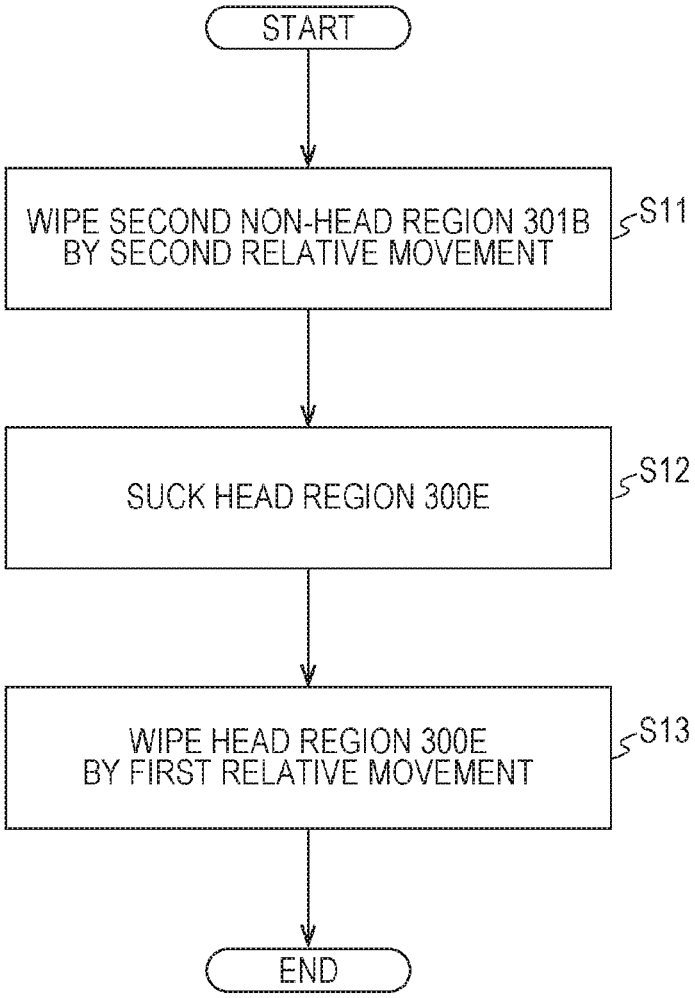
FIG. 15 is a flowchart illustrating another wiping operation according to Exemplary Embodiment 1.

An example of an operation of wiping the second non-head region 301B will be described with reference to FIG. 15. FIG. 15 is a flowchart illustrating a wiping operation.

First, in step S11, the second non-head region 301B is wiped by the wiper 61 performing the second relative movement. At this time, some of the nozzles 31 of the head region 300E adjacent to the second non-head region 301B are wiped as mentioned above. Therefore, subsequently, in step S12, the head region 300E is sucked by the suction unit 50. Hence, even if, in step S11, meniscuses in the nozzles 31 of the head region 300E are destroyed or ink with increased viscosity is pushed into the nozzles 31 by the wiping performed by the second relative movement, recovery from such a state can be achieved by the suction operation. After that, in step S13, the head region 300E having been sucked by the suction unit 50 is wiped by the wiping unit 60 performing the first relative movement. This restores meniscuses of ink in the nozzles 31 in which meniscuses have been broken by the suction unit 50 and removes from the head region 300 ink having deposited on and adhered to the head region 300 due to ink mist produced at the time of discharging ink droplets or due to the suction by the suction unit 50.

Thus, by performing the second relative movement to wipe a region that cannot be wiped by the first relative movement on the basis of the conditions 1 to 6, it is possible to reduce the unwiped regions in the nozzle surface 11 and to restrain transfer of fuzz, dust, and ink, in particular, ink with increased viscosity, having adhered to an unwiped spot, to an ejection target medium, and the falling of such fuzz, dust, or ink onto an ejection target medium at an unpredicted time.

Other Exemplary Embodiments

While an exemplary embodiment of the invention has been described above, a basic configuration of the invention is not limited to what have been described above.

For example, although in Exemplary Embodiment 1 described above, the non-head regions 301 provided in the nozzle surface 11 are the first non-head region 301A and the second non-head region 301B, the invention is not particularly limited to this. For example, it is also permissible to provide only one of the first non-head region 301A and the second non-head region 301B as a non-head region 301. In the case where the non-head region 301 in the nozzle surface 11 is only one of the first non-head region 301A and the second non-head region 301B, that non-head region 301 may be provided in only one of two side portions of the nozzle surface 11 in the second direction Y or may also be made up of two identical non-head regions 301 provided on both sides of the head region 300. That is, first non-head regions 301A may be provided on both sides of the head region 300 in the nozzle surface 11 and second non-head regions 301B may be provided on both sides of the head region 300 in the nozzle surface 11.

Although in Exemplary Embodiment 1, the wiper 61 is relatively moved in the first direction X, which is the direction in which the nozzles 31 are juxtaposed, the invention is not particularly limited to this but the wiper 61 may also be moved in the second direction Y relatively to the nozzle surface 11. However, if the wiper 61 is moved in the second directing Y relatively to the nozzle surface 11, it is more likely that ink with increased viscosity will be pushed into the nozzles 31 and there is a risk of different inks mixing together. Therefore, as in Exemplary Embodiment 1, by moving the wiper 61 in the first direction X, which is the juxtaposing direction of the nozzles 31 that discharge the same kind of ink, relative to the nozzle surface 11, the pushing of ink with increased viscosity into the nozzles 31 can be restrained and the mixture of different inks can be restrained.

Furthermore, although in Exemplary Embodiment 1, the wiper 61 is a platy member formed from an elastic material, this does not restrict the invention. For example, the wiper 61 may be made up of a porous material, such as sponge, a woven fabric, a non-woven fabric, etc. Furthermore, although, as for the wiper 61, an end portion of a platy member is brought into contact with the nozzle surface 11, this does not restrict the invention but a side surface of the wiper 61 may be brought into contact with the nozzle surface 11. That is, there is no restriction regarding the material, shape, or the like of the wiper 61 as long as the wiper 61 is able to wipe and clean the nozzle surface 11.

Furthermore, although in Exemplary Embodiment 1, the wiper 61 that wipes the head region 300 and the wiper 61 that wipes the non-head region 301 are one and the same wiper 61, this does not restrict the invention. For example, the wiper that wipes the head region 300 and the wiper that wipes the non-head region 301 may be different from each other. For example, if the wiper that wipes the head region 300 is formed from such a material into such a shape as to easily recover meniscuses of ink in the nozzles 31 and the wiper that wipes the non-head region 301 is formed from such a material into such a shape as to easily wipe fuzz, dust, and ink with increased viscosity, it is possible to efficiently wipe both regions.

Furthermore, although the wiper 61 is smaller in the second direction Y than the nozzle surface 11 in the foregoing exemplary embodiment, this does not restrict the invention. For example, even if a wiper 61 is larger in the second direction Y than the nozzle surface 11, the invention can be applied to that wiper 61 provided that the wiper 61 does not wipe the entire nozzle surface 11 by one relative movement, that is, wipes the nozzle surface 11 by a plurality of relative movements.

Furthermore, although in Exemplary Embodiment 1, the nozzle surface 11 is formed by the fixture plate 40 and the nozzle plates 32 of the head bodies 30, this does not restrict the invention but the nozzle surface 11 may be provided without the fixture plate 40. Specifically, for example, in the case where head bodies 30 are provided with a common nozzle plate, that nozzle plate may define a nozzle surface. Furthermore, the surface of the fixture plate 40 or the nozzle plate 32 may be provided with another member. In that case, a surface of the another member which faces the ejection target medium forms a nozzle surface.

Furthermore, although the foregoing ink jet type recording apparatus 1 has been illustrated as an ink jet type recording apparatus in which the recording head 10 is mounted on the carriage 5 and thereby moved in the second direction Y, which is the main scanning direction, this does not particularly restrict the invention. For example, the invention can also be applied to a so-called line type recording apparatus in which a recording head 10 is fixed to the body frame 2 and an ejection target medium is merely moved in the first direction X, which is the subsidiary scanning direction, to perform printing.

Furthermore, although in the foregoing examples, the ink jet type recording apparatus 1 has a configuration in which the ink tanks 8, which are a liquid supply unit, is fixed to the body frame 2, this does not particularly restrict the invention. For example, an ink cartridge that is a liquid supply unit may be mounted on the carriage 5. Still further, the liquid supply unit may be not mounted in the ink jet type recording apparatus.

Further, although the exemplary embodiment has been described in conjunction with an ink jet type recording apparatus as an example of the liquid ejecting apparatus, the invention has been provided broadly for liquid ejection apparatuses in general and can also be applied to liquid ejecting apparatuses that include a liquid ejection head that ejects a liquid other than ink. Examples of such liquid ejecting heads include various recording heads for use in image recording apparatuses, such as printers, color material ejecting heads for use in producing color filters for liquid crystal displays and the like, electrode material ejecting heads for use in forming electrodes of organic EL (electroluminescence) displays, FEDs (field emission displays), etc., bioorganic material ejecting heads for use in producing biochips, etc. The invention is also applicable to liquid ejecting apparatuses equipped with such liquid ejecting heads.

What is claimed is:

1. A liquid ejecting apparatus comprising:

a liquid ejecting head that has a nozzle surface, the nozzle surface including a central portion that is provided with a plurality of nozzle lines for ejecting a liquid, each of the nozzle lines extending in a first direction, and the nozzle surface including end portions that do not include nozzle lines, the end portions being formed on opposing sides of the central portion in a second direction that is orthogonal to the first direction;

a wiper for wiping the nozzle surface;

a scanning mechanism configured to cause the nozzle surface and the wiper to perform a plurality of relative movements between the nozzle surface and the wiper; and a controller configured to control the scanning mechanism, wherein the plurality of relative movements includes a first relative movement and a second relative movement that is different from the first relative movement, the first relative movement wipes the central portion of the nozzle surface in the first direction and the second relative movement wipes the end portions of the nozzle surface in the first direction; and a position of the wiper in the second direction is different between the first relative movement and the second relative movement.

2. The liquid ejecting apparatus according to claim 1, wherein the first relative movement is for wiping the nozzles and the second relative movement is for wiping the end portions of the nozzle surface that do not include the nozzle lines.

3. The liquid ejecting apparatus according to claim 1, wherein a moving speed of the second relative movement is lower than a moving speed of the first relative movement.

4. The liquid ejecting apparatus according to claim 1, wherein the second relative movement is higher in a contact pressure of the wiper on the nozzle surface than the first relative movement.

5. The liquid ejecting apparatus according to claim 1, wherein a distance between a center of the wiper and a nozzle nearest to the center of the wiper among the nozzles is longer in the second relative movement than in the first relative movement.

6. The liquid ejecting apparatus according to claim 1, wherein a number of the nozzles that are wiped is greater in the first relative movement than in the second relative movement.

7. The liquid ejecting apparatus according to claim 2, wherein a moving speed of the second relative movement is lower than a moving speed of the first relative movement.

8. The liquid ejecting apparatus according to claim 2, wherein the second relative movement is higher in a contact pressure of the wiper on the nozzle surface than the first relative movement.

9. The liquid ejecting apparatus according to claim 2, wherein a distance between a center of the wiper and a nozzle nearest to the center of the wiper among the nozzles is longer in the second relative movement than in the first relative movement.

10. The liquid ejecting apparatus according to claim 2, wherein a number of the nozzles that are wiped is greater in the first relative movement than in the second relative movement.

11. The liquid ejecting apparatus according to claim 1, wherein the controller substantially synchronizes the wiping by the second relative movement with the wiping by the first relative movement.

12. The liquid ejecting apparatus according to claim 11, further comprising a suction unit that sucks the liquid from the nozzles, wherein the controller causes the wiping by the second relative movement to be performed, then causes a suction operation by the suction unit to be performed, and then causes the wiping by the first relative movement to be performed.

13. The liquid ejecting apparatus according to claim 11, further comprising a suction unit that sucks the liquid from the nozzles, wherein the controller causes suction by the suction unit to be performed, then causes the wiping by the first relative movement to be performed, and then causes the wiping by the second relative movement to be performed.

14. The liquid ejecting apparatus according to claim 1, wherein the controller asynchronizes the wiping by the second relative movement with the wiping by the first relative movement.

15. The liquid ejecting apparatus according to claim 1, wherein in a direction in the nozzle surface which direction is orthogonal to a direction in which the relative movements between the nozzle surface and the wiper are performed, the wiper is smaller in size than the nozzle surface.

16. A wiping method for a nozzle surface of a liquid ejecting head, the nozzle surface being a central portion that is provided with a plurality of nozzle lines for ejecting a liquid, each of the nozzle lines extending in a first direction, and the nozzle surface including end portions on opposing sides of the central portion that do not include nozzle lines in a second direction that is orthogonal to the first direction, the wiping method comprising performing a first wiping with a wiper that wipes in the first direction the nozzle lines of the central portion of the nozzle surface and a second wiping with the wiper that wipes in the first direction the end portions of the nozzle surface that does not include the nozzle lines; and a position of wiper in the second direction is different between the first relative movement and the second relative movement.

17. A wiping method for a nozzle surface of a liquid ejecting head, the nozzle surface being provided with a central portion that includes a plurality of nozzle lines for ejecting a liquid, each of the plurality of nozzle lines extending in a first direction, and the nozzle surface including end portions on opposing sides of the central portion that do not include nozzle lines in a second direction that is orthogonal to the first direction, the wiping method comprising a first relative movement that includes performing a first wiping with a wiper that wipes in the first direction the nozzle lines of the central portion nozzle surface and a second relative movement that includes performing a second wiping with the wiper that wipes in the first direction the end portions of the nozzle surface that do not include the nozzle lines, wherein the first wiping and the second wiping are different from each other in a distance between a center of the wiper and a nozzle that is nearest to the center of the wiper among the nozzles and in a distance that the wiper and the nozzle surface are moved relative to each other to wipe the nozzle surface; and a position of the wiper in the second direction is different between the first relative movement and the second relative movement.

* * * * *